United States Patent [19]

Nelson

[11] 4,010,955

[45] Mar. 8, 1977

[54] CELL GAME

[76] Inventor: Richard Clay Nelson, P.O. Box 217, Glenwood, N. Mex. 88039

[22] Filed: June 18, 1975

[21] Appl. No.: 588,029

[52] U.S. Cl. ..... 273/134 C; 35/18 R; 273/134 E; 273/134 AT

[51] Int. Cl.[2] ..... A63F 3/00

[58] Field of Search ..... 273/134

[56] References Cited

UNITED STATES PATENTS 3,740,038 6/1973 Feulner ..... 273/134 AD

*Primary Examiner*—Delbert B. Lowe

[57] ABSTRACT

A game board and components for instruction of cellular functions and structures has identical cellular and environmental areas depicted thereon and a continuous playing path around its edge. Chance means direct movements of game pieces along the path, and indicators on the path direct placing of components from a "bank" into cellular environment, cellular cytoplasm or cell nucleus.

Each player is assigned a portion of the cellular cytoplasm and environment and fills designated, delineated spaces therein in accordance with moves directed by the game apparatus during play. Filling of blank spaces simulates various scientific and biological functions and structural components found in living plant and animal cells. The structures and functions operative in the game include: active transport, amino acids, adenosine triphosphate (ATP), carbon dioxide, cellular environment, cellular membrane, chlorophyll, chloroplast, chromosome, concentration, cytoplasm, diffusion, deoxyribonucleic acid (DNA), endoplasmic reticulum, enzyme, fat, fatty acid, gene, glucose, glycerol, Golgi apparatus, maltose, mitochondrion, nuclear membrane, nucleus, oxygen, pH, protein, ribosome, synthesis and water.

1 Claim, 6 Drawing Figures

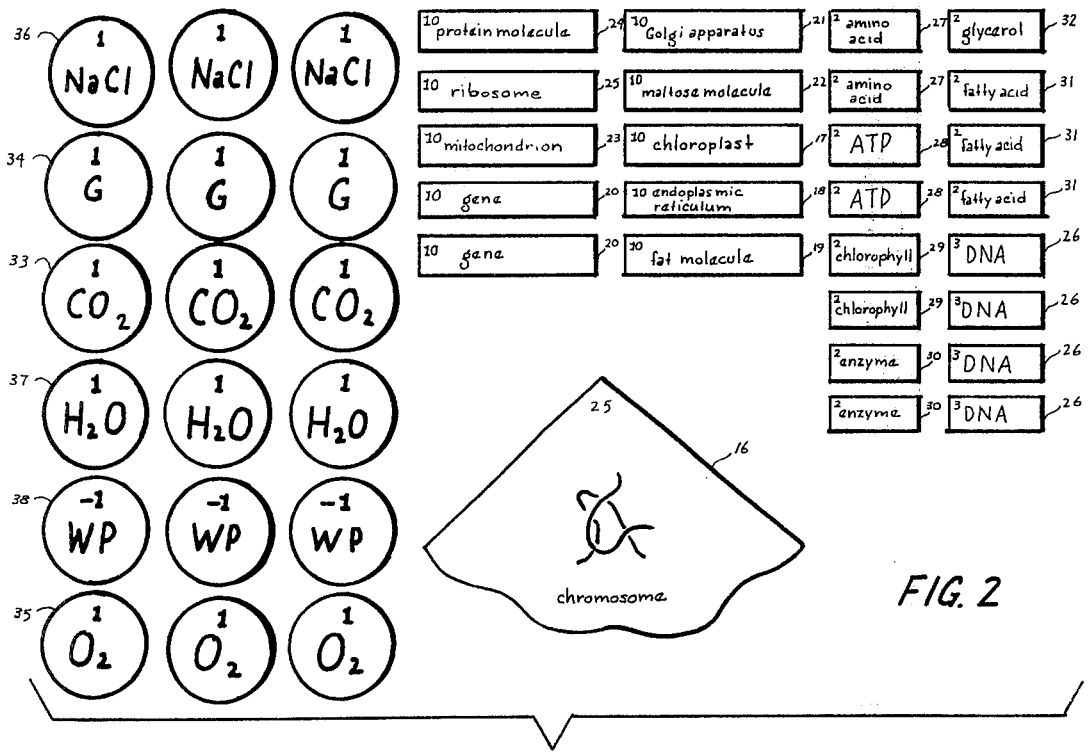
FIG. 2
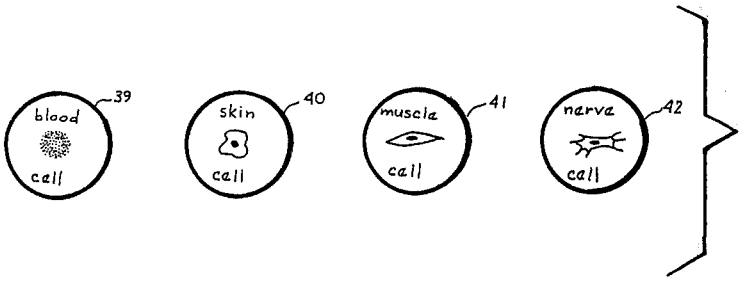
FIG. 3
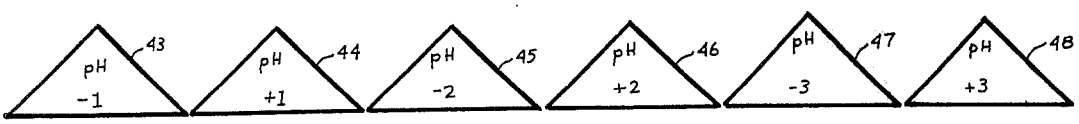
FIG. 4
FIG. 5
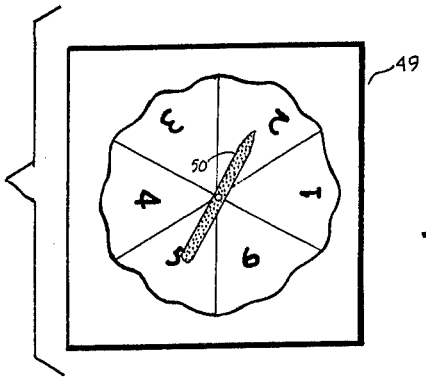
FIG. 6
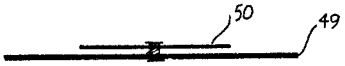

CELL GAME

This invention relates to board games and particularly to board games involving animal and plant cell structures and functions. There is a need for an educational and recreational game board which simulates and depicts basic structures and functions of living cells. Several kits and games are available which demonstrate in particular ways the structure and functions of detailed aspects of cells, but there are no games to the knowledge of this inventor which simulate overall cellular structures and functions.

BACKGROUND OF THE INVENTION

The game enables the players to simulate many of the structural and functional aspects of plant and animal cells. The study of the basic components of living cells is being taught in schools from the elementary level through college level. Many of the aspects of the study of cells require extreme magnifications and involve concepts which are difficult for many students to grasp at such a small level. Also, in living cells many functions are very complex, and said complexity makes it difficult for many students to understand even the basic structures and functions of cells. Molecules, at least individually, are not visible to the naked eye. There is a need for an educational/recreational game which enables players to visualize these concepts.

The study of cells (cytology) is carried on throughout the world and is of global concern. The answers to many diseases have come at the cellular level, and indeed such widely diverse diseases as cancer, multiple sclerosis and many mental illnesses may come at this level of study. All living plants and animals, including man, have cells and cell products as their basic structural building block. Cytology is truly an interdisciplinary science, encompassing certain aspects of such fields as medicine, physics, chemistry and mathematics. A thorough knowledge of cells may indeed determine which direction mankind might take in the future. An interested and informed citizenry will help to determine this direction, and this game was designed to increase knowledge and interest of students in the study of cells.

The present game simplifies cellular functions and structures in both a qualitative and quantitative manner. Instead of millions of a particular kind of molecule in an individual cell, players are involved with no more than three such molecules at one time in playing the game. A similar simplification follows for other cell components. Many students fail to become interested in terse textbook descriptions of cell structures and functions. The present game is designed to increase interest in such students. Many students look upon game boards as sources of enjoyment and recreation, and the present game is designed to encompass such activity along with learning of basic scientific principles.

SUMMARY OF THE INVENTION

Applicant chooses to call his game "THE CELL GAME." "THE CELL GAME" is a board game for two, three or four players. It is designed to provide each player with an opportunity to use knowledge and chance in building a hypothetical "complete" cell on the game board. A winner is determined from amongst the participants. The game can be played by players with different backgrounds as concerns knowledge. While a certain amount of background and knowledge of cells can be helpful, there is also a certain element of chance involved, making it possible for a less knowledgeable player to win over a more knowledgeable one. The game embodies a "correcting factor" in which a player may correct an error (a move or procedure made not in accordance with the rules) made by another player and thereby gain an advantage by making such a correction.

The first player to fill all of the delineated spaces within the cell which have numbers in them shall be the winner. Inasmuch as the game often must be completed during a specific time period, an alternative method of determining the winner is to declare that player who has accumulated the most net total points within his cell's cytoplasm less a correcting factor for accumulated pH cards (to be discussed later). All players, just by chance alone, will score points during the game. This provides an incentive factor for the less knowledgeable player.

A "bank" is provided for each player, and he draws playing components from this source. A stack of pH cards is available for all players to draw from should their mover land in a space directing them to select a pH card. All movements around the playing path are determined by a number where the arrow on a spinner card points. Movement of spinner is simply by flipping it with a finger. Numbered choices are 1 through 6 inclusive. Each player has a "mover" which is moved long the spaces in the playing path according to results of flipping the spinner.

BRIEF DESCRIPTION OF THE DRAWINGS

FIG. 2 is a top plan view of cell components and molecules (playing components). An individual player's set is shown. There are a total of four sets.

FIG. 3 is a top plan view of "movers."

FIG. 4 is a top plan view showing one each of the different pH cards for present game.

FIG. 5 is a top plan view of plastic arrow and printed spinner card.

FIG. 6 is a side plan view of a plastic arrow and a printed spinner card.

DESCRIPTION OF PREFERRED EMBODIMENT

Figure 1:
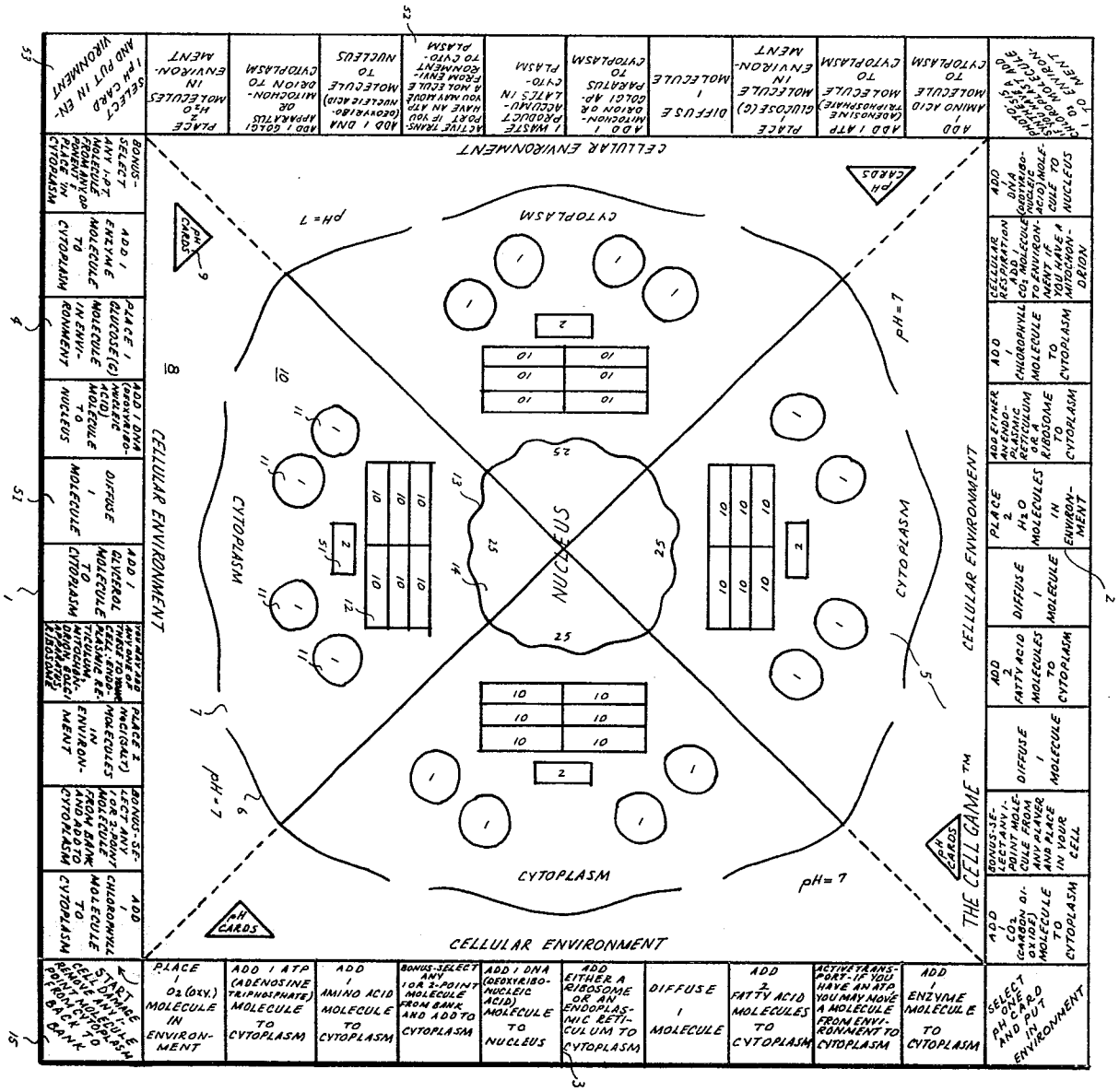
FIG. 1 is a top plan view of a game board for the present invention.

The game board 1 is preferably foldable along either a transverse line 2 or along transverse line 2 and a second fold along line 3. Folding of game board is to facilitate shipping and storing. Board is unfolded and lies flat in play. The game board 1 has delineated thereon an outer playing path 4 divided into a multiplicity of sequential areas, each such area or space containing directions for a player's next step in playing the game, as will be described in more detail later. The central area 5 of the game board 1 has delineated thereon the outline of a hypothetical living animal/-plant cell. The outer perimeter 6 represents the cell membrane and has spaces 7 in it to permit certain molecules to enter and leave the cell. The cell in the central area is divided into four equal segments, each segment being in front of one edge of the playing path. Between the cell membrane 6 and the playing path 4 is an area designated as the cellular environment 8. The cellular environment is divided into four equal segments corresponding with the four segments of the cell.

Within each of the four delineated cellular environment areas 8 is a triangle 9 marked "pH cards." The pH of the cellular environment at start of play is pH 7. Inside the cell membrane 6 is an area of playing board representing the cytoplasm 10. Each player's portion of the cell contains an equal area of cytoplasm. There are a total of four such areas on the playing board. Within the delineated area of cytoplasm 10 in each player's portion of the playing board are four circles 11, each with the number "1" inside. In addition, there are delineated six rectangular areas 12, each with the number "10" inside. In addition, there is a single delineated rectangular area 51 with the number "2" inside. Also, in the center of the cell is delineated an area known as the nucleus 14, the delineating line 13 representing the nuclear membrane. The nucleus is subdivided into four equal segments, each corresponding with each player's portion of the cell. Each such divided area is marked with the number "25."

Each of the different player's section of the cell on the playing board is preferably of a different color to facilitate distinction. All four areas are equal, and there is no advantage in having any particular area over another. The cellular environment is preferably a lighter shade of the same color as the corresponding cell for each player. The cytoplasm and nucleus of each of the four different "cells" is therefore a darker shade than the same-colored cellular environment.

The playing path is utilized by all players. Start of play is from a common space in the playing path which is marked with the word "START" and a directional arrow 15.

The playing components (FIG. 2) consist of delineated parts preferably die cut from heavy stock. Numbers on playing components represent points. There are a total of four sets of components in game, but only one such set is shown in FIG. 2. Two sets are used if two players play, three sets for three and four sets for four. Each set of components (per player) consists of the following (each set is readily recognized as each is of a different color, the color preferably corresponding to the color of the cytoplasm in that player's "cell"): chromosomes 16 — one part, marked with "25"; chloroplast 17 — one part, marked with a "10"; endoplasmic reticulum 18 — one part, marked with a "10"; fat molecule 19 — one part, marked with a "10"; gene 20 — two parts, each marked with a "10"; Golgi apparatus 21 — one part, marked with a "10"; maltose molecule 22 — one part, marked with a "10"; mitochondrion 23 — one part, marked with a "10"; protein molecule 24 — one part, marked with a "10"; ribosome 25 — one part, marked with a "10"; deoxyribonucleic acid (DNA) molecule 26 — four parts, each marked with a "3"; amino acid molecule 27 — two parts, each marked with a "2"; andenosine triphosphate (ATP) molecule 28 — two parts, each marked with a "2"; chlorophyll molecule 29 — two parts, each marked with a "2"; enzyme molecule 30 — two parts, each marked with a "2"; fatty acid molecule 31 — three parts, each marked with a "2"; glycerol molecule 32 — one part, marked with a "2"; carbon dioxide ($CO_2$) molecule 33 — three parts, each marked with a "1"; glucose (G) molecule 34 — three parts, each marked with a "1"; oxygen ($O_2$) molecule 35 — three parts, each marked with a "1"; salt (NaCl) "molecule" 36 — three parts, each marked with a 1"; water ($H_2O$) molecule 37 — three parts, each marked with a "1"; waste product duct (WP) molecule 38 — three parts, each marked with a "−1." Each player selects one "mover" (FIG. 3). These are delineated circles, each of a different color corresponding to the color of that player's cytoplasm on the board. The "movers" have the names of different cells on them. These are "blood cell" 39, "skin cell" 40, "muscle cell" 41 and "nerve cell" 42. "Movers" are moved along the playing path in accordance with members which turn up when the arrow on the spinner (see below) is flipped.

A single set of non-colored, delineated triangles (FIG. 4) are marked as follows: "pH −1" 43 — four parts; "pH +1" 44 — four parts; "pH −2" 45 — eight parts; "pH +2" 46 — eight parts; "pH −3" 47 — four parts; "pH +3" 48 — four parts.

The preferred embodiment of all playing components (FIGS. 2, 3 and 4) will be a single die-cut sheet (preferably heavy stock paper) with all components ready to be pushed out for play.

A spinner board 49 consists of a heavy card on which is delineated the cellular membrane with the internal area divided into six equal-sized segments. The segments are numbered consecutively one through six inclusive. An arrow 50, preferably of plastic, is mounted on the spinner board with a rivet or fastening device in such manner that the arrow will freely turn when flipped with a finger. The entire device is designed such that the probability of the arrow stopping at any segment one through six is about equal. The spinner device is utilized in determining the movement of "movers" 39, 40, 41, 42 along the playing path, each number on the spinner board representing the movement of a "mover" one space. A five on the face of the card, as an example, would indicate that the "mover" be placed five spaces ahead of where it last stopped.

A rules sheet describes special rules and methods of play which are embodied below.

All playing board, components, spinner and rules are preferably packaged in a large envelope or flat box for storage and shipping.

PLAY OF THE GAME

The game board 1 should be positioned such that each player faces his selected color. Selection of color should simply be done by choice or "first-come, first-served." Player should select the "mover" 39, 40, 41, 42 which corresponds to the color of the game board closest to him. Each player should select all components 16–38 of the corresponding color and place these face up in an area outside of the game board. These components may be arranged in any fashion that makes them readily accessible for the player. The "movers" 39–42 for each player should be placed within the space on the playing path 4 indicated by the word "START" and which also contains a directional arrow.

One player (any player) should pick up the stack of pH cards 43–48 and shuffle them. The cards are then placed in a single stack, face down, in such a location that any player may reach the topmost card of the stack.

Each player flips the spinner arrow 50, and the player whose arrow lands on the highest number on the spinner card 49 starts play. A single die could be used as a substitute for the spinner device.

The first player spins the arrow 50 and advances his "mover" 39–42 the number of spaces along the playing path 4 corresponding to the number the arrow points to on the spinner card. Play progresses from one player to the next in a clockwise motion, and movement of "movers" along the playing path also progresses only in a clockwise manner. When a mover "mover" ends up at a space along the playing path, the player follows directions as indicated in that space. The second player does not spin the arrow until the first player has completed following the directions in the space of the playing path. The second (and subsequent) players are those positioned clockwise to the first player. Play continues around the board until completion of game (see below). When play returns to first player, for example, he again spins the arrow and continues moving his "mover" around the playing path continuing from the space where his "mover" last stopped. Movement is determined by the number on the spinner card which the arrow points at.

Objective of play of "The Cell Game" is to construct one "complete" cell. A "complete" cell, for purposes of this game, shall consist of having the following components within either the cytoplasm or nucleus of the cell on the playing board for that player (all components must be in that individual player's colored, delineated section of the board) and within the cell membrane; components within the cellular environment do not count for points although pH cards in the cellular environment may adjust the total score (see below): any one 25-point structure (chromosome) plus any six 10-point structures or molecules plus any one 2-point molecule plus four different 1-point molecules. In a "complete" cell, all of the spaces with numbers in them in a particular player's cytoplasm will be filled with appropriate components and there will be a chromosome in the nucleus.

A shorter version of the game involves simply designating a certain period of play, 40 minutes as an example. At end of playing period, each player adds up points of components within his cell membrane and makes adjustments for pH variation from the ideal of "7" (see below). The player with the most net points shall be the winner.

Special rules and procedures involved in the game and not otherwise explicit from directions already given or those on the spaces of the playing path are as follows:

Diffusion 51 may take place only from regions of high concentrations of molecules to regions of low concentrations of molecules. Diffusion may take place only using one-point molecules 33–37 and minus one-point molecules (WP) 38. Diffusion occurs only between cellular environment and cytoplasm (passing through the cell membrane) in a player's cell. Movement may be from the cellular environment into the cytoplasm or vice versa. In reference to concentrations of molecules, concentrations refer to molecules of a single kind only. As a general example, if there were more one-point molecules of one kind on one side of the cell membrane than there were molecules of the same kind on the other side of the cell membrane, and the player's "mover" landed on a space directing him to diffuse a molecule, he could only move a molecule from the side of the cell membrane where there were more molecules of that kind to the side where there were not as many molecules of that particular kind. As a specific example, if there are two water molecules in the player's cellular environment and only one water molecule in the player's cytoplasm, and the space where his "mover" lands directs him to diffuse a molecule, he will be required to diffuse (move) one water molecule from the environment into the cytoplasm. Diffusion is not to take place if concentrations of one kind of one-point molecule inside and outside of the cell membrane are equal. If a player ends up at a space which requests that he diffuse a molecule, he must do this if he has the necessary components on the game board, even if it means diffusing a molecule from the cytoplasm back out to the cellular environment.

If the player's "mover" lands on a space marked "Active Transport" 52, a one-point molecule 33–38 may be moved against the concentration gradient if he has an ATP molecule 28 in the cytoplasm of his portion of the game board. As an example, a player landing on a space marked "Active Transport" who also has an ATP molecule 28 in his cell's cytoplasm could move a one-point molecule (such as $H_2O$) into the cytoplasm from the environment, even if there are more $H_2O$ molecules in the cytoplasm than in the cellular environment. A player not having an ATP molecule 28 in the cytoplasm of his cell cannot have molecules undergo active transport.

At end of playing period, if no player has a "complete" cell on the game board, all waste product (WP) molecules 38 shall count one point each against the total score of the other structures and molecules in that player's cytoplasm and nucleus.

If a player makes an ERROR and moves a structure or molecule not according to the various rules of the game, and if another player points out this error before the next player's turn, the player pointing out the error may remove any molecule from the cell of the player making the error and place an identical molecule (but of the color of his cell) into his cell's cytoplasm. The player making the error must then return his molecule back to his "bank."

If a player's "mover" lands on a pH space 53, he should select the top pH card from the single stack which has been set aside face down. He then places the selected card right-side up in the delineated space for pH cards in his cell's cellular environment 8. At beginning of play of game, the ideal pH reading of the cellular environment shall be considered to be pH 7. At end of playing perod, if no player has a "complete" cell on the playing board, the total of the pH points in each player's cellular environment is determined by adding the total points on each of his pH cards, and the difference between the figure obtained and the ideal pH of 7 is calculated. This figure is then subtracted from the total points of all the components in the cell cytoplasm and cell nucleus. The player with the largest number of net points shall be the winner. Examples: If the cellular environment of a particular player's cell is pH 11 at game's end, subtract four points from the total of points he has in his cell; or, if the pH is 2, subtract five points from the total of points in his cell.

Certain things which are required to fill some of the delineated, numbered areas in the cytoplasm and nucleus on the game board can be obtained only by SYNTHESIZING smaller molecules or structures. These specific components are listed below. When you synthesize smaller components into larger ones, the smaller components should be returned to the "bank" and not left in the cytoplasm or nucleus of the cell. Such returned components may be used again if in accordance with the rules and directions on the playing path. A player may synthesize components whenever he has the necessary parts and it is his turn: chromosome 16 — trade two genes 20 into bank; gene 20 — trade two DNA 26 molecules into bank; fat molecule 19 — trade one glycerol molecule 32 plus three fatty acid molecules 31 into bank; maltose molecule 22 — trade two glucose (G) molecules 34 into bank; protein molecule 24 — trade two amino acid molecules 27 into bank (A player must have one endoplasmic reticulum 18 and one ribosome 25 in his cytoplasm before he can synthesize a protein molecule. When a player trades in the amino acid molecules for a protein molecule, he should keep the endoplasmic reticulum and the ribosome in his cell); chloroplast 17 — trade two chlorophyll molecules 29 into bank.

Play continues, following the various rules and procedures described, until a winner is declared. The foregoing are merely illustrative of preferred method of playing the game and preferred specific rules. It is understood, however, that the rules and/or specific content of any direction space on playing path 4 may be changed without departing from the scope of appended claims.

I claim:

1. Game apparatus comprising a game board having a continuous playing path therearound and a central area; means in said central area defining representation of a living plant/animal cell including cell nucleus and nuclear membrane, cell cytoplasm, cell membrane; the area between the delineated playing path and cell membrane representing cellular environment; means in said area dividing the cytoplasm, nucleus and cellular environment into four equal playing segments; delineated areas within the cytoplasm and the entire area delineated by a segment of the nucleus with spaces to be filled during the course of play with playing components; said delineated areas on said game board having numerals matching those on the playing components; a delineated area within the cellular environment for pH cards; an area within the delineated cellular environment for placement of playing components; delineated cell membrane with spaces to permit movement of playing components from the cellular environment area of the playing board into the cytoplasm area of the playing board and from the cytoplasm area of the playing board into the cellular environment area of the playing board; a plurality of playing components dimensioned to fit within delineated spaces within the cell cytoplasm and cell nucleus; said components being marked with names and numerical values, the names being those of cell molecules and structures; said continous playing path divided into sequential areas, each having directions for a player in regard to placement of playing components onto or off of the playing board; a plurality of additional playing pieces known as pH cards which are marked to designate various values of pH and which may be taken from a single source outside the playing board and placed in delineated areas provided for said cards in the cellular environment; means of determining the extent of movement of playing pieces along said playing path.

* * * * *